US012577075B2

(12) United States Patent
Yonemoto

(10) Patent No.: US 12,577,075 B2
(45) Date of Patent: Mar. 17, 2026

(54) SHEET PROCESSING UNIT THAT SWITCHES TRANSPORT DESTINATION OF SHEET

(71) Applicant: KYOCERA Document Solutions Inc., Osaka (JP)

(72) Inventor: Satoru Yonemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 16 days.

(21) Appl. No.: 18/765,340

(22) Filed: Jul. 8, 2024

(65) Prior Publication Data

US 2025/0019196 A1 Jan. 16, 2025

(30) Foreign Application Priority Data

Jul. 11, 2023 (JP) ..... 2023-113431

(51) Int. Cl.
*B65H 29/60* (2006.01)
*B65H 29/58* (2006.01)

(52) U.S. Cl.
CPC ..... *B65H 29/60* (2013.01); *B65H 29/58* (2013.01); *B65H 2801/27* (2013.01)

(58) Field of Classification Search
CPC ..... B65H 29/60; B65H 29/58
See application file for complete search history.

(56) References Cited

U.S. PATENT DOCUMENTS 5,154,411 A * 10/1992 Saito ..... G03G 15/6552 271/289
6,250,631 B1 6/2001 Hanamoto et al.
7,976,021 B2 * 7/2011 Matsuo ..... G03G 15/6552 271/305
10,054,893 B2 * 8/2018 Kotani ..... G03G 15/6552
10,351,379 B2 * 7/2019 Shirasaki ..... B41J 13/0009
10,472,197 B2 * 11/2019 Hotani ..... B65H 31/10

FOREIGN PATENT DOCUMENTS

JP 2000169033 A 6/2000

* cited by examiner

*Primary Examiner* — Patrick Cicchino
(74) *Attorney, Agent, or Firm* — IP Business Solutions, LLC.

(57) ABSTRACT

A sheet processing unit includes a postprocessing apparatus and a sorting device. The postprocessing apparatus performs postprocessing on a printed sheet. The sorting device is removably attached to the postprocessing apparatus, and sorts the printed sheet to a predetermined tray. The postprocessing apparatus includes a postprocessing device and a processing destination switch guide. The postprocessing device performs postprocessing on the sheet. The processing destination switch guide switches a destination of the sheet to be processed, between the postprocessing device and the sorting device. The sorting device includes a sorting destination switch guide and a guide drive device. The sorting destination switch guide switches the tray to which the sheet is to be sorted. The guide drive device drives the sorting destination switch guide. The guide drive device also drives the processing destination switch guide.

2 Claims, 8 Drawing Sheets

SHEET PROCESSING UNIT THAT SWITCHES TRANSPORT DESTINATION OF SHEET

INCORPORATION BY REFERENCE

This application claims priority to Japanese Patent Application No. 2023-113431 filed on Jul. 11, 2023, the entire contents of which are incorporated by reference herein.

BACKGROUND

The present disclosure relates to a sheet processing unit.

Sheet processing units have been proposed that include a postprocessing apparatus that performs postprocessing, such as a sheet binding operation, on a printed sheet, and a sorting device attachable to the postprocessing apparatus, and configured to sort the sheets to a mail tray.

Some of such sheet processing units are configured to switch, with a switch guide provided on the postprocessing apparatus, the destination of the printed sheet to be subjected to the postprocessing. The switch guide switches the destination of the sheet, between a postprocessing device that performs the postprocessing, and the sorting device.

SUMMARY

The disclosure proposes further improvement of the foregoing techniques.

In an aspect, the disclosure provides a sheet processing unit including a postprocessing apparatus and a sorting device. The postprocessing apparatus performs postprocessing on a printed sheet. The sorting device is removably attached to the postprocessing apparatus, and sorts the printed sheet to a predetermined tray. The postprocessing apparatus includes a postprocessing device and a processing destination switch guide. The postprocessing device performs postprocessing on the sheet. The processing destination switch guide switches a destination of the sheet to be processed, between the postprocessing device and the sorting device. The sorting device includes a sorting destination switch guide and a guide drive device. The sorting destination switch guide switches the tray to which the sheet is to be sorted. The guide drive device drives the sorting destination switch guide. The guide drive device also drives the processing destination switch guide.

DETAILED DESCRIPTION

Figure 1:
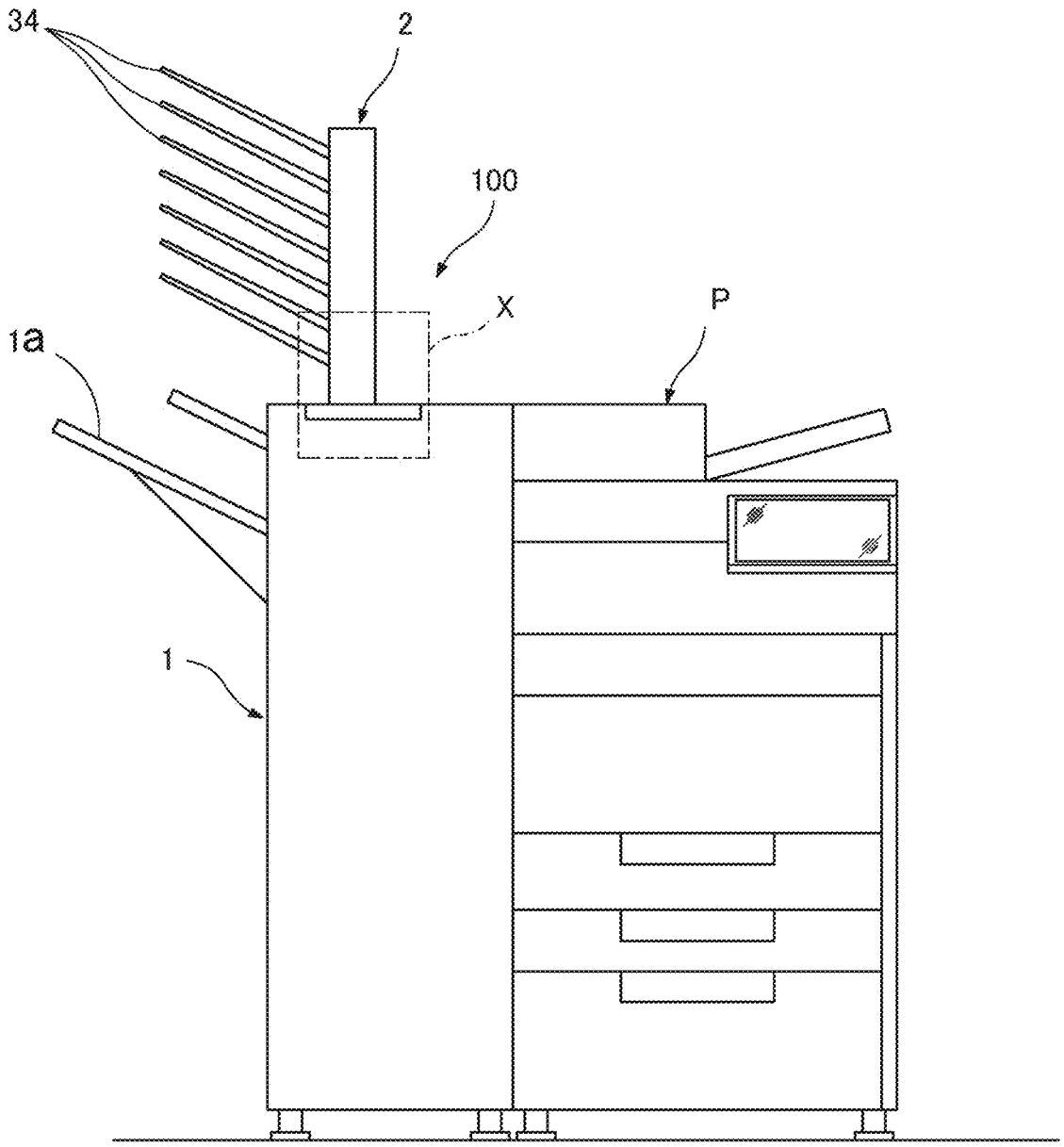
FIG. 1 is a schematic front view for explaining a form of use of a sheet processing unit according to an embodiment of the disclosure.

Hereafter, a sheet processing unit according to an embodiment of the disclosure will be described, with reference to the drawings. In the drawings, the same or corresponding elements are given the same numeral, and the description of such elements will not be repeated.

Referring to FIG. 1, an example of the form of use of the sheet processing unit 100 will be described. FIG. 1 is a schematic front view for explaining the form of use of the sheet processing unit 100.

As shown in FIG. 1, the sheet processing unit 100 is located adjacent to a side face of a printer P, for example configured as a multifunction peripheral. The sheet processing unit 100 includes a postprocessing apparatus 1 and a sorting device 2.

The postprocessing apparatus 1 performs postprocessing on a printed sheet. The postprocessing apparatus 1 may also be referred to as a finisher that performs, as specific examples, stapling, punching, and folding, to the printed sheet. The postprocessing apparatus 1 is installed adjacent to the side face of the printer P. The sheet printed by the printer P is delivered from the side face of the printer P, and introduced into the postprocessing apparatus 1, through the side face thereof. The sheet that has undergone the postprocessing is delivered to an output tray 1*a*, provided on the other side face of the postprocessing apparatus 1.

The sorting device 2 is removably attached to the postprocessing apparatus 1, and configured to transport the sheet to a predetermined mail tray 34 (hereinafter, simply "tray"), out of a plurality of mail trays 34. The sorting device 2, which may also be referred to as a mailbox, includes 5 to 7 stages of trays 34. The use of the sorting device 2 prevents the printed materials from being mixed up, when a plurality of persons are using the multifunction peripheral. In this embodiment, the sorting device 2 is attached to the upper face of the postprocessing apparatus 1.

Figure 2:
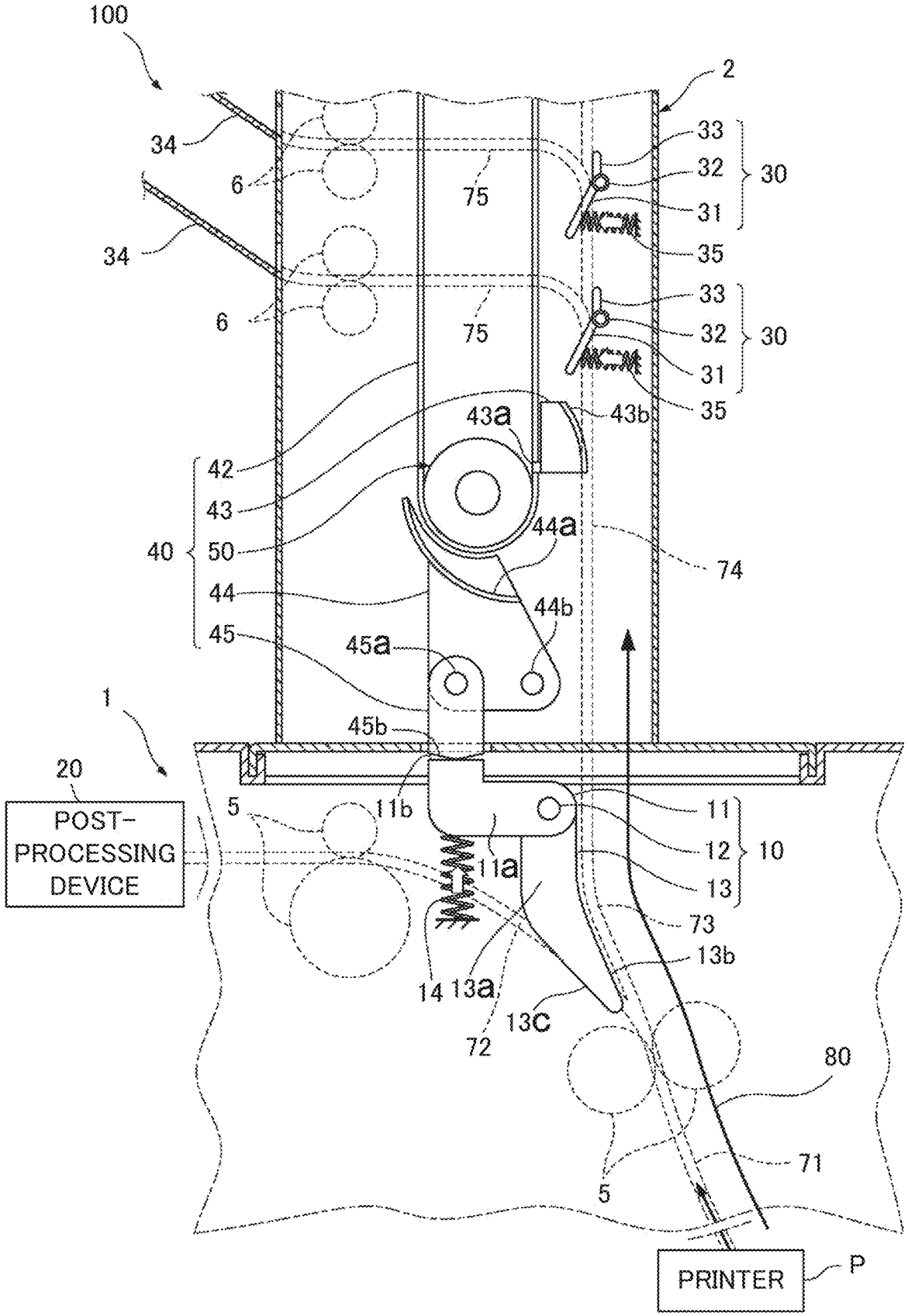
FIG. 2 is a vertical cross-sectional view of the sheet processing unit.

Referring to FIG. 2, a configuration of the sheet processing unit 100 will be described. FIG. 2 is a vertical cross-sectional view showing an internal structure of a portion indicated by X in FIG. 1, of the sheet processing unit 100.

As shown in FIG. 2, the postprocessing apparatus 1 includes a postprocessing device 20 and a processing destination switch guide 10. The postprocessing device 20 includes a mechanism that performs finishing operations such as stapling, and performs the postprocessing on the sheet delivered from the printer P.

The processing destination switch guide 10 includes a force receiving member 11, a guide member 13, and a rotary shaft 12. The force receiving member 11 and the guide member 13 are attached to the rotary shaft 12. The force receiving member 11 and the guide member 13 are attached to different positions in the longitudinal direction of the rotary shaft 12, thus to be connected to each other via the rotary shaft 12. The force receiving member 11 and the guide member 13 are configured to rotate interlocked with each other, about the rotary shaft 12.

The processing destination switch guide 10 is retained in a predetermined posture, by a spring 14. However, when the force receiving member 11 is subjected to an acting force, the force receiving member 11 is made to rotate against the biasing force of the spring 14, so that the guide member 13 is also made to rotate. The guide member 13 is located at the position where a transport route 71 is branched into a transport route 72 and a transport route 73. The transport route 71 extends from the printer P to the processing destination switch guide 10. The transport route 72 extends from the position where the processing destination switch guide 10 is located, to the postprocessing device 20. The transport route 73 extends from the position where the processing destination switch guide 10 is located, to the sorting device 2.

The processing destination switch guide 10 is configured to block one of the transport routes 72 and 73 for the sheet with the guide member 13, by rotating the guide member 13 to either side, thereby guiding the sheet to the other transport route not blocked by the guide member 13.

In other words, the processing destination switch guide 10 switches the transport route for the sheet between the transport routes 72 and 73, thereby switching the destination of the printed sheet to be processed, between the postprocessing device 20 and the sorting device 2.

To be more specific, out of the sheets delivered from the printer P, the sheet to be subjected to the postprocessing by the postprocessing device 20 is guided by the processing destination switch guide 10, after passing through the transport route 71, and transported toward the postprocessing device 20 through the transport route 72, by a transport roller 5.

On the other hand, out of the sheets delivered from the printer P, the sheet to be sorted by the sorting device 2, instead of being subjected to the postprocessing by the postprocessing device 20, is guided by the processing destination switch guide 10 to the transport route 73, and delivered upward from the upper face of the postprocessing apparatus 1, to the sorting device 2.

The sorting device 2 includes a plurality of sorting destination switch guides 30, and a guide drive device 40 that drives the sorting destination switch guides 30.

The plurality of sorting destination switch guides 30 are respectively provided for the plurality of trays 34. The sorting destination switch guides 30 each include a force receiving member 31, a guide member 33, and a rotary shaft 32. The force receiving member 31 and the guide member 33 are attached to the rotary shaft 32. The force receiving member 31 and the guide member 33 are attached to different positions in the longitudinal direction of the rotary shaft 32, thus to be connected to each other via the rotary shaft 32. The force receiving member 31 and the guide member 33 are configured to rotate interlocked with each other, about the rotary shaft 32. The force receiving member 31 is attached to the rotary shaft 32, at a position deviated from the region where the sheet passes (on the outer side of the sheet), in the width direction of the sheet being transported through a transport route 74, in other words the longitudinal direction of the rotary shaft 32. The guide member 33 is attached to the rotary shaft 32, at a position inside the region where the sheet passes (position where the guide member 33 contacts the sheet), in the width direction of the sheet.

The sorting destination switch guide 30 is retained in a predetermined posture, by a spring 35. However, when the force receiving member 31 is subjected to an acting force, the force receiving member 31 is made to rotate against the biasing force of the spring 35, so that the guide member 33 is also made to rotate. The guide member 33 is located at the position where the transport route 74 is branched to a transport route 75 extending to the tray 34.

The guide member 33, normally kept from blocking the transport route 74 by the spring 35, assumes the posture for blocking the transport route 74 upon being made to rotate against the biasing force of the spring 35, thereby guiding the sheet to the transport route 75. The sheet thus guided is transported by a transport roller 6 through the transport route 75 extending to the corresponding tray 34, and delivered thereto.

In other words, the sorting destination switch guides 30 selectively switch, among the plurality of trays 34, the tray 34 to which the printed sheet is to be sorted.

The guide drive device 40 includes a moving element 42, an acting member 43, a link mechanism 44/45, and a roller group 50.

The roller group 50 includes a plurality of rollers to be subsequently described, and causes a moving element 42 stretched around a pair of rollers to endlessly revolve, thus moving the moving element 42. In the illustrated example, the moving element 42 has a looped (endless) cord shape, and is stretched around the roller group 50. When the roller group 50 rotates, the moving element 42 endlessly moves in the longitudinal direction thereof. On the surface of the moving element 42, the acting member 43 is attached. By being made to move by the roller group 50, the moving element 4 moves the acting member 43 in the same moving direction. In other words, the acting member 43 moves along the looped route, together with the moving element 4.

By being made to move along the looped route, the acting member 43 causes the sorting destination switch guides 30 and the link mechanism 44/45 to exert the acting force.

The link mechanism 44/45 is located between the moving element 42 stretched around the roller group 50, and the processing destination switch guide 10 inside the postprocessing apparatus 1, when the sorting device 2 is attached thereto. The link mechanism 44/45 includes a rotating member 44 rotatable about a rotary shaft **44*b*, and a connection member 45 rotatable about a rotary shaft 45*a* provided on the rotating member 44. The distal end portion of the connection member 45 is intruding into inside of the postprocessing apparatus 1 through the casing of the sorting device 2, so that the acting force exerted by the moving acting member 43 is transmitted via an acting surface 45*b*, to the processing destination switch guide 10 biased upward by the spring 14**.

Figure 3:
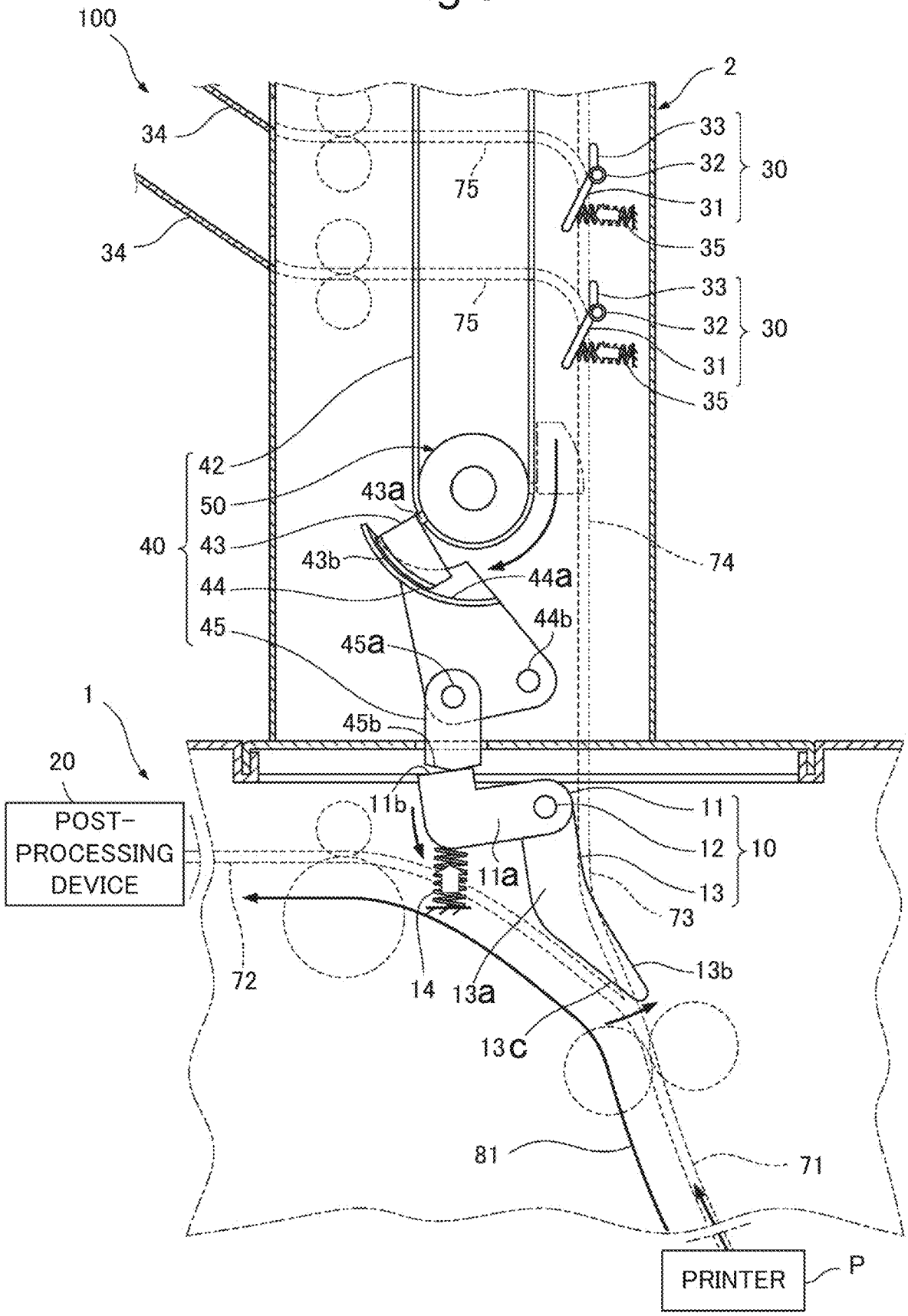
FIG. 3 is a vertical cross-sectional view of the sheet processing unit, showing a state where a processing destination switch guide has been switched.

Referring to FIG. 2 and FIG. 3, the processing destination switch guide 10 will be described in further detail. FIG. 3 is a vertical cross-sectional view of the sheet processing unit 100, showing a state where the processing destination switch guide 10 has been switched.

As already described, the processing destination switch guide 10 includes the force receiving member 11, the guide member 13, and the rotary shaft 12.

The force receiving member 11 includes a main body **11*a* having an L-shape in a side view. The main body 11*a* includes an abutment surface 11*b*, located at an end portion opposed to the acting surface 45*b* of the connection member 45. The abutment surface 11*b* is located at the position where the acting surface 45*b* of the connection member 45 of the link mechanism 44/45 makes contact, so as to receive the acting force from the acting surface 45*b***.

The guide member 13 includes a wedge-shaped main body **13*a*, and guide surfaces 13*b* and 13*c* located on the distal end portion of the main body 13*a*. The guide member 13 is configured to block one of the transport route 71 and the transport route 72, to thereby guide the sheet to the other transport route, with the guide surface 13*b* or the guide surface 13*c***.

Here, the main body **11*a* of the force receiving member 11 is subjected to a pressing force of the spring 14, biasing the abutment surface 11*b* upward. Accordingly, the processing destination switch guide 10 is urged to rotate clockwise about the rotary shaft 12, in the state shown in FIG. 2. However, since the abutment surface 11***b* is in contact with the acting surface 45*b* of the connection member 45 as shown in FIG. 2, the processing destination switch guide 10 is restricted from rotating, in this state.

In the mentioned state, when the acting member 43 is located away from the rotating member 44 as shown in FIG. 2, the processing destination switch guide 10 assumes the posture for blocking the transport route 72, so that the guide surface 13*b* guides the sheet to the transport route 73, as indicated by an arrow 80. In other words, when the acting member 43 is located away from the rotating member 44, the processing destination switch guide 10 assumes the posture for guiding the sheet toward the sorting device (hereinafter referred to as "sorting device guiding posture"), owing to the biasing force of the spring 14.

Then, when the moving element 42 revolves from the position shown in FIG. 2, so that the acting member 43 reaches the position to contact the link mechanism 44/45 and presses the link mechanism 44/45 as shown in FIG. 3, the acting member 43 causes the link mechanism 44/45 to rotate counterclockwise in FIG. 2, so that the acting surface 45*b* presses the abutment surface 11*b*, with the force exerted in the direction opposite to the biasing force of the spring 14. Accordingly, the processing destination switch guide 10 changes the posture by rotating counterclockwise in FIG. 2 about the rotary shaft 12, thereby switching the transport route through which the sheet is to be guided.

As result of such switching action, the guide member 13 of the processing destination switch guide 10 blocks the transport route 73, and the guide surface 13*c* guides the sheet to the transport route 72, as indicated by an arrow 81 in FIG. 3. Thus, the processing destination switch guide 10 assumes the posture for guiding the sheet to the postprocessing device 20 (hereinafter referred to as "postprocessing device guiding posture"), by receiving the switching force from outside, namely the link mechanism 44/45.

As described above, the processing destination switch guide 10 is switched from the sorting device guiding posture to the postprocessing device guiding posture, by receiving the switching force. As result, the guide drive device 40 can switch the processing destination switch guide 10 to the postprocessing device guiding posture, by exerting the switching force, when there is no need to perform the switching operation of the sorting destination switch guide 30.

By the transmission of the force from the link mechanism 44/45 to the processing destination switch guide 10, the guide drive device 40 drives the processing destination switch guide 10 provided in the postprocessing apparatus 1, so as to switch the destination of the sheet to be processed.

Figure 4:
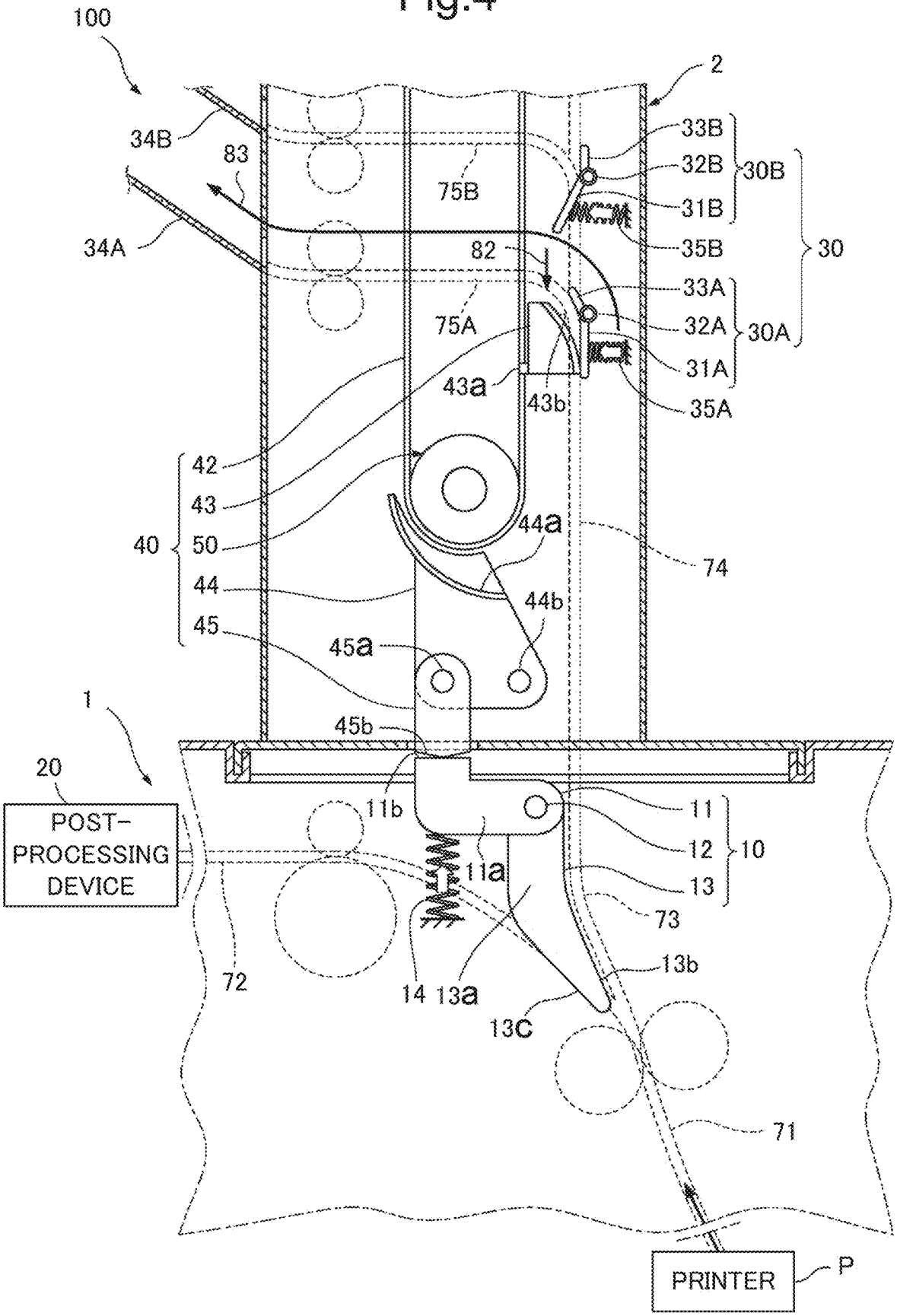
FIG. 4 is a vertical cross-sectional view of the sheet processing unit, showing a state where a sorting destination switch guide has been switched.

Referring now to FIG. 4, the sorting destination switch guide 30 will be described in detail. FIG. 4*s* a vertical cross-sectional view of the sheet processing unit 100, showing a state where one of the sorting destination switch guides 30 has been switched.

As shown in FIG. 4, the sorting destination switch guides 30A and 30B are respectively associated with the trays 34A and 34B. The sorting destination switch guide 30A or 30B includes a force receiving member 31A or 31B, a rotary shaft 32A or 32B, and a guide member 33A or 33B, respectively.

The force receiving members 31A and 31B are subjected to the pressing force of the springs 35A and 35B, via the face opposite to the face to be contacted by the sloped surface 43*b*. This pressing force is biasing the sorting destination switch guides 30A and 30B so as to rotate clockwise in FIG. 4, about the rotary shafts 32A and 32B. Accordingly, when the sloped surface 43*b* of the acting member 43 is not in contact with the sorting destination switch guide 30A or 30B, the guide member 33A or 33B is located so as not to contact the sheet being transported through the transport route 74, thus assuming the posture for keeping from guiding the sheet to the tray 34BA or 34B (hereinafter simply referred to as "posture not for sorting").

The force receiving members 31A and 31B are the members against which the sloped surface 43*b* of the acting member 43, moving along the looped route, is to be abutted. When the sloped surface 43*b* of the acting member 43 is abutted against the force receiving member 31A or 31B, the sloped surface 43*b* exerts the acting force to the force receiving member 31A or 31B. Here, since the acting member 43 is located away from the link mechanism 44/45 at this point, the processing destination switch guide 10 is assuming the posture to guide the sheet to the transport route 74, owing to the biasing force of the spring 14.

Thus, the sloped surface 43*b* of the acting member 43, which has reached the force receiving member 31A or 31B because of the revolution of the moving element 42, exerts the switching force, which is the acting force necessary for switching the sorting destination switch guide 30A or 30B, to the force receiving member 31A or 31B in the direction opposite to the biasing force of the spring 35A or 35B. As result, the sorting destination switch guide 30A or 30B is made to rotate counterclockwise in FIG. 4, about the rotary shaft 32A or 32B.

FIG. 4 illustrates the state where the sloped surface 43*b* of the acting member 43, transported in the direction indicated by an arrow 82, is exerting the switching force to the force receiving member 31A of the sorting destination switch guide 30A, out of the sorting destination switch guides 30A and 30B.

Accordingly, the sorting destination switch guide 30A is made to rotate counterclockwise in FIG. 4 as a whole, about the rotary shaft 32A, to the position where the guide member 33A makes contact with the sheet being transported through the transport route 74. Therefore, the guide member 33A blocks the transport route 74, and assumes the posture for guiding the sheet in the direction indicated by an arrow 83, toward the transport route 75A (hereinafter simply referred to as "posture for sorting").

Here, the sorting destination switch guide 30B is also switched between the posture for guiding the sheet to the transport route 75B and the posture for not guiding the sheet to the transport route 75B, through the same action as that applied to the sorting destination switch guide 30A.

Then, when the sorting destination switch guide 30A is switched to the posture for not guiding the sheet to the transport route 75A, and the sorting destination switch guide 30B is switched to the posture for guiding the sheet to the transport route 75B, the sheet being transported through the transport route 74 passes the position where the sorting destination switch guide 30A is located, and is guided to the position where the sorting destination switch guide 30B is located. The sheet guided to the position of the sorting destination switch guide 30B is guided by the guide member 33B of the sorting destination switch guide 30B to the transport route 75B, thus to be transported to the tray 34B.

As described above, the sorting destination switch guide 30 is subjected to the biasing force of the springs 35A and 35B, as mechanical force from outside, to maintain the posture for not guiding the sheet to the transport routes 75A and 75B. Accordingly, when the switching force is not exerted by the sloped surface 43*b* of the acting member 43, the sorting destination switch guide 30 maintains the posture for not guiding the sheet to the transport routes 75A and 75B. Then upon receiving the switching force from the acting member 43, the sorting destination switch guide 30 is switched to the posture for guiding the sheet to the transport route 75A or 75B.

Thus, with the switching force exerted by the acting member 43, the sorting destination switch guide 30 is switched from the posture for not guiding the sheet to the transport routes 75A and 75B, to the posture for guiding the sheet to the transport route 75A or 75B. In other words, the guide drive device 40 switches, by exerting the switching force, the posture of the sorting destination switch guide 30 corresponding to the tray that is the destination of the sheet.

Figure 5:
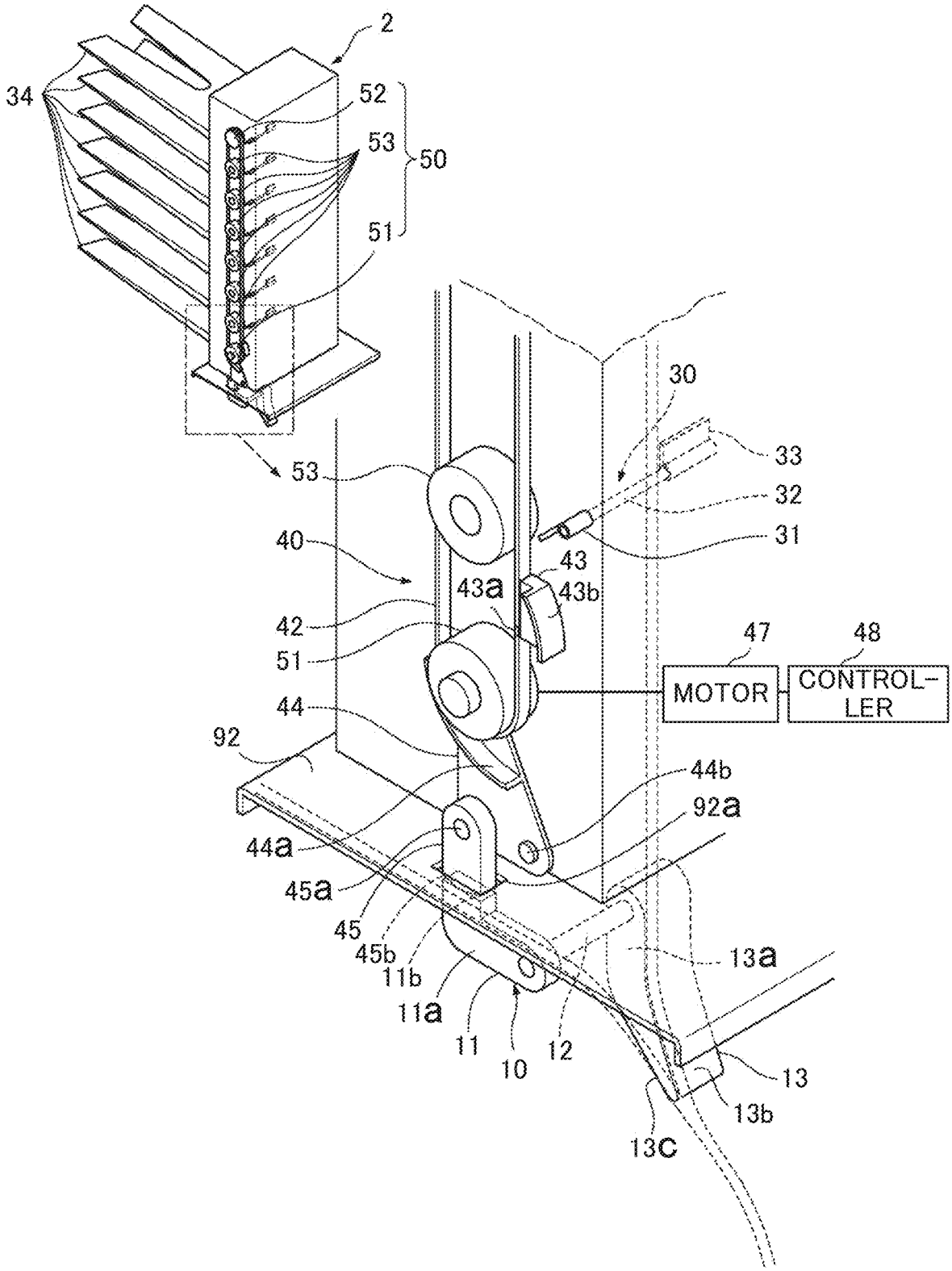
FIG. 5 is a perspective view showing a guide drive device.

Referring now to FIG. 5 in addition to FIG. 4, the overall configuration of the guide drive device 40 will be described in detail. FIG. 5 is a perspective view showing the entirety of the guide drive device 40.

As shown in FIG. 5, the guide drive device 40 includes a motor 47, acting as the drive source. The guide drive device 40 includes the roller group 50, the moving element 42, the acting member 43, and a controller 48.

The roller group 50 includes a roller 51 driven by the motor 47, and another roller 52 constituting a pair with the roller 51, and a plurality of rollers 53 located between the pair of rollers 51 and 52.

The moving element 42 is stretched around the roller group 50. The moving element 42 is typically a looped cord, exemplified by a belt in this embodiment. Here, the moving element 42 may be, for example, formed of a chain.

The acting member 43 includes an attaching portion 43*a* and the sloped surface 43*b*. The acting member 43 is fixed to the moving element 42 via the attaching portion 43*a*, and located on the side of the outer circumferential surface of the moving element 42, stretched in the loop shape around the roller group 50. The sloped surface 43*b* is located farther away from the moving element 42, with respect to the attaching portion 43*a*. The sloped surface 43*b* is inclined so as to make the upper portion of the acting member 43 narrower and the lower portion wider, in FIG. 5.

The controller 48 controls the motor 47, according to a user's instruction inputted to a non-illustrated operation device (e.g., instruction indicating to which tray to sort the sheet, and instruction to execute the postprocessing), so as to locate the acting member 43 at the position corresponding to the instruction. For example, the controller 48 may control the position of the acting member 43, using the rotation angle of the roller 51 as a parameter. The controller 48 includes a processor such as a central processing unit (CPU), a communication device, and a storage device.

With the mentioned configuration, when the roller group 50 is driven to rotate so that the moving element 42 revolves along the looped route, the acting member 43 is also made to move along the looped route. When the acting member 43 is made to move clockwise in FIG. 4 and FIG. 5 along the looped route, the sloped surface 43*b* of the acting member 43 exerts the switching force to the sorting destination switch guide 30. As specific structure, the link mechanism 44/45 is composed of the rotating member 44 and the connection member 45.

The rotating member 44 constituting a part of the link mechanism 44/45 includes an arcuate surface 44*a* and the rotary shaft 44*b*. The arcuate surface 44*a* is where the sloped surface 43*b* of the acting member 43, moving together with the moving element 42, makes contact thereby exerting the acting force (pressing force) of the acting member 43. The rotary shaft 44*b* is supporting the rotating member 44 so as to rotate clockwise and counterclockwise in FIG. 4 and FIG. 5. The rotating member 44 rotates about the rotary shaft 44*b* against the biasing force of the spring 14, upon being subjected to the acting force of the acting member 43, moving clockwise along the looped route.

The connection member 45 is connected to a part of the rotating member 44. The connection member 45 includes the rotary shaft 45*a* and the acting surface 45*b*. The rotary shaft 45*a* is rotatably supporting the connection member 45.

The connection member 45 is inserted, along the longitudinal direction thereof, through a through hole 92*a* formed in a part of a bottom face 92 of the sorting device 2, so as to move therethrough in the longitudinal direction.

As described above, the acting member 43 exerts the switching force to the sorting destination switch guide 30 and the processing destination switch guide 10, thereby switching the posture of those switch guides.

Thus, the guide drive device 40 can exert the switching force to each of the switch guides 10 and 30. In other words, each of the switch guides 10 and 30 can be driven, by a single unit of the guide drive device 40 provided in the sorting device 2.

Accordingly, the postprocessing apparatus 1 does not have to have a single-purpose drive device, dedicated to drive the processing destination switch guide 10 provided in the postprocessing apparatus 1. In other words, the sheet processing unit 100 is configured to utilize the guide drive device 40 as a common drive source for switching the postures of the sorting destination switch guide 30 and the processing destination switch guide 10. Therefore, the structure of the sheet processing unit 100 can be simplified, which leads to a reduction in cost of the product.

In addition, forming the moving element 42 in the cord shape enables the guide drive device 40 to exert the switching force to the plurality of sorting destination switch guides 30. Therefore, the plurality of sorting destination switch guides 30 can be driven by the single unit of the guide drive device 40, provided in the sorting device 2.

The processing destination switch guide 10 can change the posture, by being driven by the guide drive device 40, so as to select one of the postprocessing device 20 and the sorting device 2 as the destination of the sheet, in other words to selectively switch the destination of the sheet.

Likewise, the sorting destination switch guide 30 can also change the posture, by being driven by the guide drive device 40, so as to select one of the plurality of trays 34 as the destination of the sheet, in other words to selectively switch the destination of the sheet.

Thus, the guide drive device 40 can drive each of the switch guides 10 and 30, thereby switching the posture of each the switch guides 10 and 30. As result, the postprocessing apparatus 1 does not have to have a single-purpose drive device, dedicated to drive the processing destination switch guide 10 provided in the postprocessing apparatus 1. Therefore, the structure of the sheet processing unit 100 can be simplified.

For example, the aforementioned existing sheet processing unit requires a drive source for driving the switch guide, inside the postprocessing apparatus. Therefore, the structure of the sheet processing unit becomes complicated. In contrast, the sheet processing unit 100 according to the foregoing embodiment can be manufactured in a simplified structure.

Figure 6:
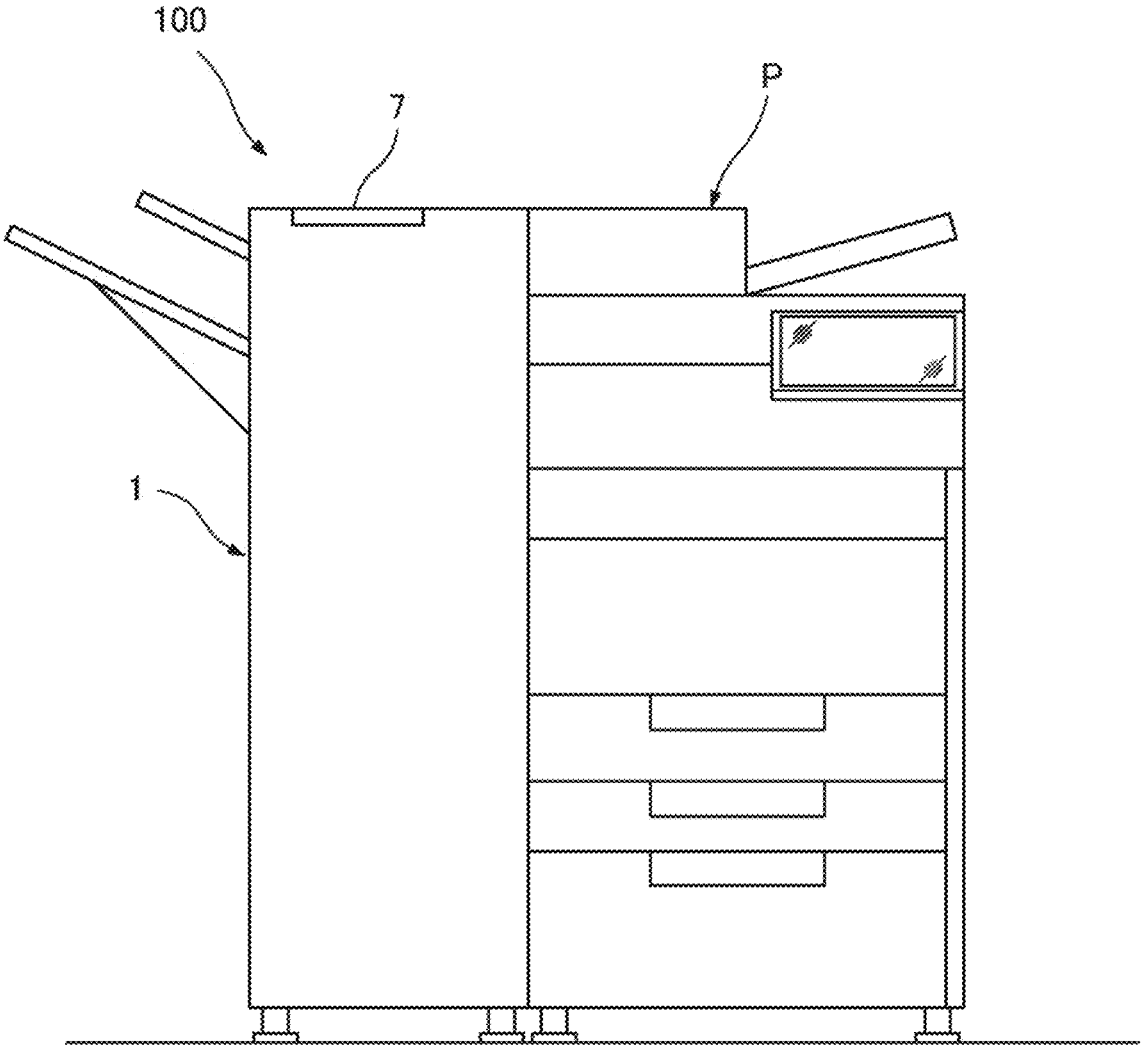
FIG. 6 is a schematic front view for explaining another form of use of the sheet processing unit.

Referring now to FIG. 6, another form of use of the sheet processing unit 100 will be described.

As already described, the sorting device 2 is removably attached to the postprocessing apparatus 1. FIG. 6 is a schematic front view for explaining the other form of use of the sheet processing unit 100, showing the case where the sorting device 2 is removed.

As shown in FIG. 6, the sheet processing unit 100 in this form of use includes, in place of the sorting device 2 that has been removed, a cover 7 attached to the postprocessing apparatus 1 at the position where the sorting device 2 was attached. The cover 7 is, like the sorting device 2, removably attached to the mentioned position on the postprocessing apparatus 1.

Figure 7:
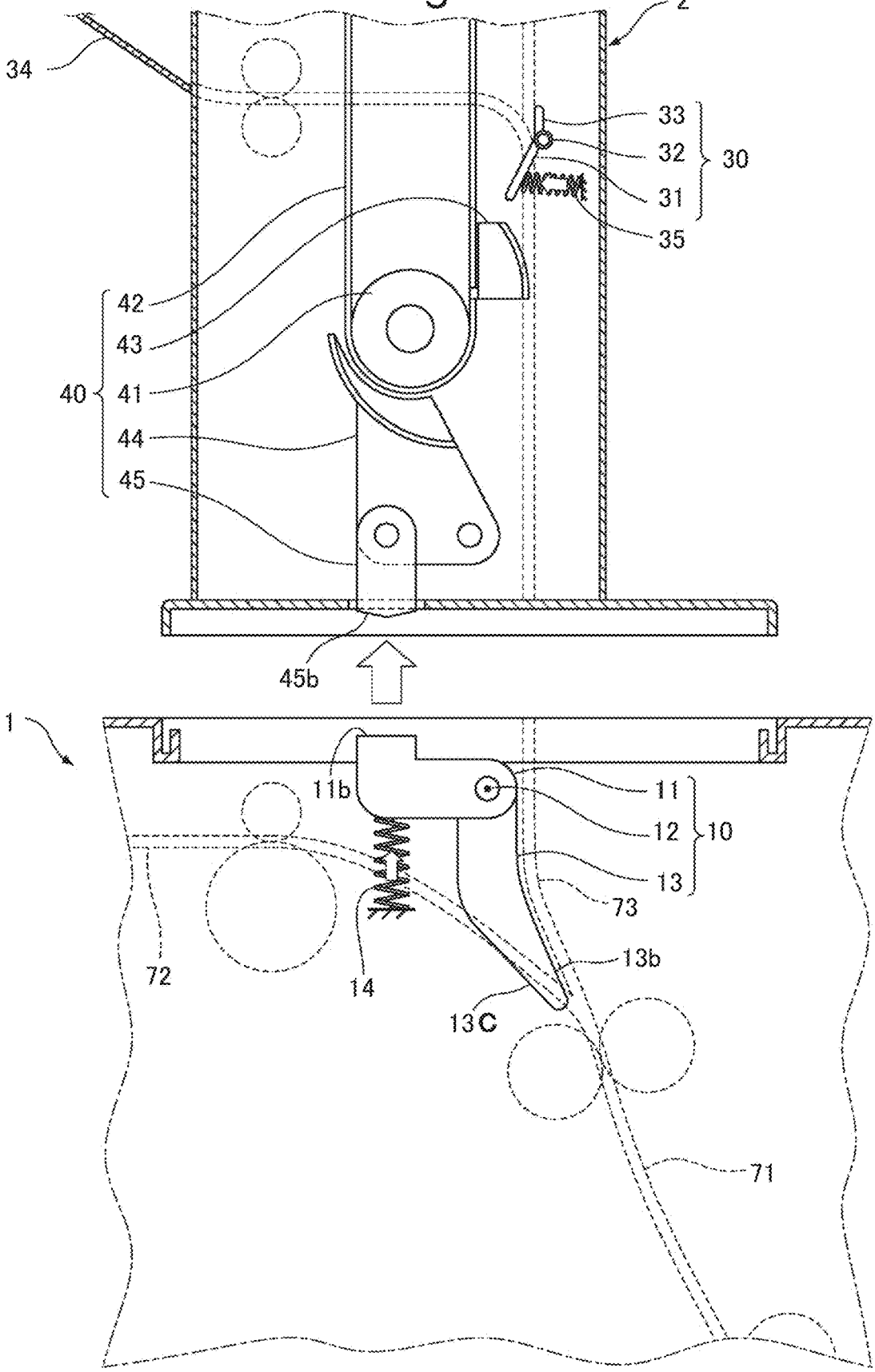
FIG. 7 is a vertical cross-sectional view of the sheet processing unit, with a sorting device removed.
Figure 8:
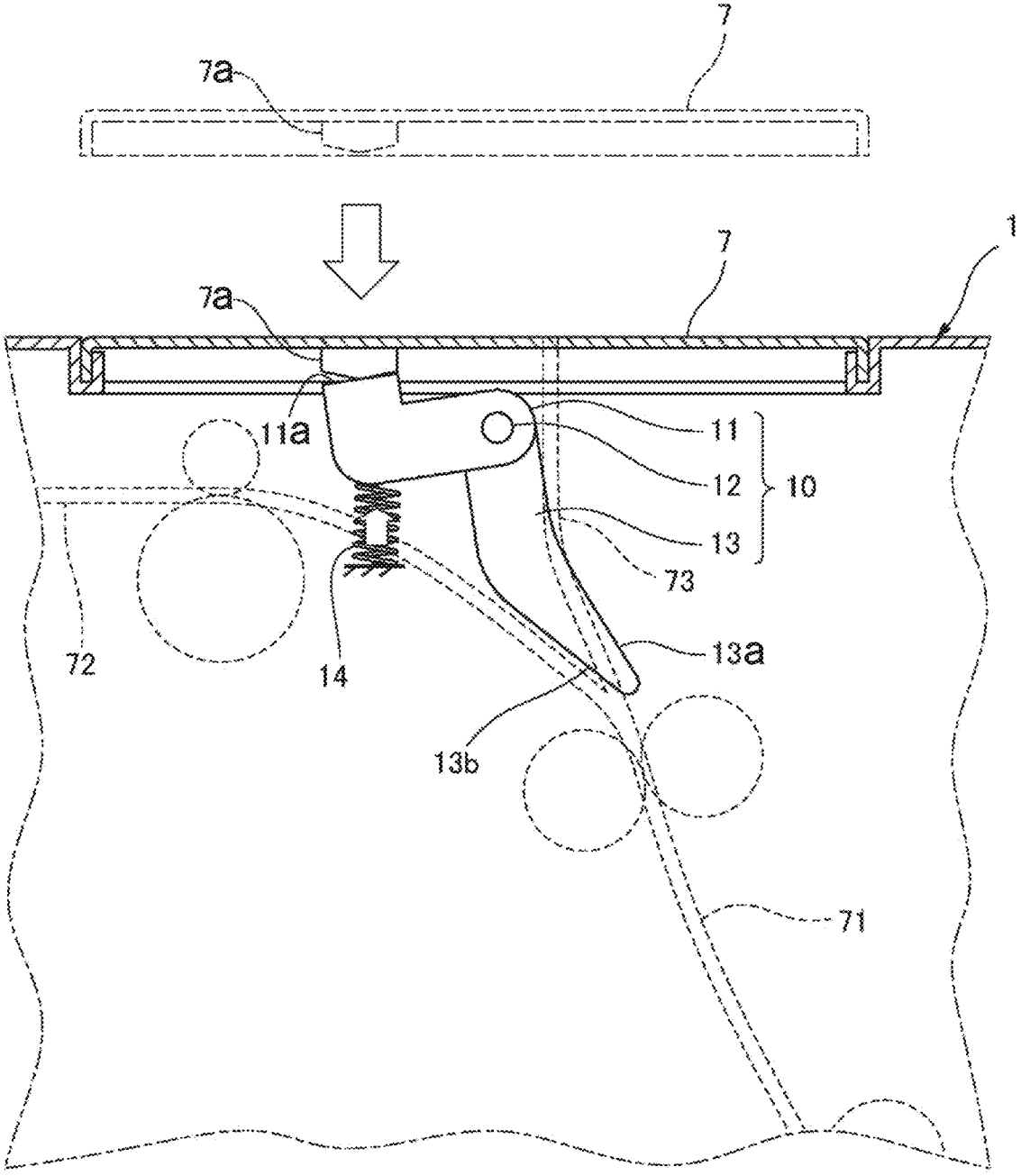
FIG. 8 is a vertical cross-sectional view showing another form of use of the sheet processing unit.

Referring to FIG. 7 and FIG. 8, the configuration of the sheet processing unit 100 in the case of the other form of use will be described. FIG. 7 is a vertical cross-sectional view of the sheet processing unit 100, with a sorting device 2 removed. FIG. 8 is a vertical cross-sectional view of the sheet processing unit 100 in the other form of use.

As shown in FIG. 7, when the sorting device 2 is removed from the postprocessing apparatus 1, the acting surface 45*b* of the connection member 45 is separated from the abutment surface 11*b* of the force receiving member 11. Because of the sorting device 2 having been removed, the upper space of the abutment surface 11*b* of the force receiving member 11, which is biased upward by the spring 14, is opened up, and therefore the abutment surface 11*b* becomes accessible through the upper space.

As shown in FIG. 8, the cover 7 includes a protrusion 7*a*. The protrusion 7*a* is located so as to contact the abutment surface 11*b* of the force receiving member 11, when the cover 7 is attached to the postprocessing apparatus 1. In addition, the protruding height of the protrusion 7*a* is equal to the displacement amount of the connection member 45 toward the postprocessing apparatus 1, realized when the acting member 43 exerts the acting force to the rotating member 44, thereby displacing the connection member 45 downward, in the state where the sorting device 2 is attached to the postprocessing apparatus 1.

Accordingly, the protrusion 7*a*, which is a part of the cover 7 attached to the postprocessing apparatus 1, serves to exert the switching force to the processing destination switch guide 10 against the biasing force of the spring 14, thereby switching the posture of the processing destination switch guide 10 to the postprocessing device guiding posture, because the protrusion 7*a* has, as described above, the height necessary for such switching action.

Therefore, when the sorting device 2 is removed and the cover 7 is attached instead, the processing destination switch guide 10 is set to the postprocessing device guiding posture. As result, in the form of use without the sorting device 2 also, no additional element for switching the processing destination switch guide 10 is required, and therefore the structure of the sheet processing unit 100 can be simplified.

The configuration of the guide drive device 40 is not limited to the above, provided that the drive device 40 is capable of driving both of the sorting destination switch guide 30 and the processing destination switch guide 10. Any modifications made within the ordinary creativity of persons skilled in the art are included in the scope of the disclosure. From the viewpoint of technical idea, different link mechanisms may be adopted, other than the link mechanism 44/45 specifically described above. The guide drive device 40 may also be substituted with a configuration based on different drive system, without limitation to the belt type according to the foregoing embodiment.

In other aspects also, the configuration and the working principle in the disclosure may be modified within the ordinary creativity of persons skilled in the art, without departing from the scope of the technical idea set forth in the appended claims.

The embodiment of the disclosure has been described as above, with reference to the drawings. However, the disclosure is not limited to the foregoing embodiment, but may be modified in various manners, without departing from the scope of the disclosure. The drawings each schematically illustrate the elements for the sake of clarity, and the thickness, length, number of pieces, and interval of the illustrated elements may be different from the actual ones, because of the convenience in making up the drawings. Further, the material, shape, and size of the elements referred to in the foregoing embodiment are merely exemplary and not specifically limited, and may be modified as desired, without substantially departing from the configuration according to the disclosure.

What is claimed is:

1. A sheet processing unit comprising:

a postprocessing apparatus that performs postprocessing on a printed sheet;

a sorting device removably attached to the postprocessing apparatus, and configured to sort the printed sheet to a predetermined tray, wherein the postprocessing apparatus includes:

a postprocessing device that performs postprocessing on the sheet; and a processing destination switch guide that switches a destination of the sheet to be processed, between the postprocessing device and the sorting device, the sorting device includes:

a sorting destination switch guide that switches the tray to which the sheet is to be sorted; and a guide drive device that drives the sorting destination switch guide, and the guide drive device also drives the processing destination switch guide, wherein the processing destination switch guide changes a posture so as to selectively switch the destination of the sheet to be processed, between the postprocessing device and the sorting device, the sorting destination switch guide changes a posture so as to selectively switch the destination of the sheet among a plurality of the sorting destinations, and the guide drive device exerts a switching force for switching the posture, to each of the processing destination switch guide and the sorting destination switch guide, wherein the processing destination switch guide receives a mechanical force that sets the destination of the sheet to the sorting device, and switches the destination of the sheet to the postprocessing device, by further receiving the switching force, wherein the sorting destination switch guide receives a mechanical force that causes the sorting destination switch guide to assume the posture for not sorting the sheet to the tray, and assumes the posture for sorting the sheet to the tray, by further receiving the switching force, wherein the guide drive device includes:

a moving element stretched around a driving body; and an acting member attached to the moving element, and the acting member changes the posture of each of the sorting destination switch guide and the processing destination switch guide, by exerting thereto the switching force, wherein the moving element includes a cord-shaped body, the sheet processing unit further comprises a cover attached to the postprocessing apparatus in place of the sorting device, when the sorting device is removed from the postprocessing apparatus, wherein a part of the cover attached to the postprocessing apparatus switches the posture of the processing destination switch guide, by exerting thereto the switching force.

2. The sheet processing unit according to claim 1, wherein the part of the cover attached to the postprocessing apparatus includes a protrusion, and the protrusion switches the processing destination switch guide to the posture for guiding the sheet to the postprocessing apparatus, by exerting the switching force to the processing destination switch guide.

* * * * *